US009414443B2

(12) United States Patent
Fujinami et al.

(10) Patent No.: US 9,414,443 B2
(45) **Date of Patent: *Aug. 9, 2016**

(54) INDUCTION HEATING DEVICE

(75) Inventors: Tomoya Fujinami, Shiga (JP); Sunao Okuda, Shiga (JP); Naoaki Ishimaru, Shiga (JP); Akira Kataoka, Shiga (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 608 days.

This patent is subject to a terminal disclaimer.

(21) Appl. No.: 13/203,893

(22) PCT Filed: Nov. 20, 2009

(86) PCT No.: PCT/JP2009/006270

§ 371 (c)(1),
(2), (4) Date: Aug. 30, 2011

(87) PCT Pub. No.: WO2010/100697

PCT Pub. Date: Sep. 10, 2010

(65) Prior Publication Data

US 2011/0315674 A1 Dec. 29, 2011

(30) Foreign Application Priority Data

Mar. 4, 2009 (JP) ..... 2009-050059

(51) Int. Cl.
*H05B 6/12* (2006.01)
*H05B 6/06* (2006.01)

(52) U.S. Cl.
CPC ..... *H05B 6/062* (2013.01); *H05B 2206/022* (2013.01); *H05B 2213/07* (2013.01)

(58) Field of Classification Search
USPC ..... 219/620, 621, 622, 623, 624, 626
See application file for complete search history.

(56) References Cited

U.S. PATENT DOCUMENTS 3,742,175 A * 6/1973 Harnden, Jr. ..... 219/627
4,351,996 A * 9/1982 Kondo et al. ..... 219/625

(Continued)

FOREIGN PATENT DOCUMENTS

CN 1642366 A 7/2005
CN 1645974 A 7/2005

(Continued)

OTHER PUBLICATIONS

International Search Report for International Application No. PCT/JP2009/006270, dated Feb. 23, 2010, 2 pages.

(Continued)

*Primary Examiner* — Dana Ross
*Assistant Examiner* — Ayub Maye
(74) *Attorney, Agent, or Firm* — Brinks Gilson & Lione

(57) ABSTRACT

An induction heating device includes a top plate (2) on which a cooking container is placed, an infrared ray sensor (3) configured to detect an infrared ray radiated from the cooking container through the top plate, a heating coil (4) to which a high-frequency electric current is supplied to generate an induction magnetic field for heating the cooking container, a mounting plate (6) on which a member for supporting the heating coil is mounted, and a heating control unit (8) configured to control an electric power for heating the cooking container by controlling the high-frequency electric current supplied to the heating coil based on an amount of an energy of the infrared ray received by the infrared ray sensor. The infrared ray sensor is thermally connected to the mounting plate.

5 Claims, 2 Drawing Sheets

(56) References Cited

U.S. PATENT DOCUMENTS

| | | | | |
|---|---|---|---|---|
| 6,225,607 | B1 | 5/2001 | Has et al. | |
| 7,049,564 | B2 * | 5/2006 | Takada et al. | 219/627 |
| 7,102,109 | B2 * | 9/2006 | Niiyama et al. | 219/627 |
| 7,157,674 | B2 * | 1/2007 | Miyauchi et al. | 219/621 |
| 7,173,224 | B2 * | 2/2007 | Kataoka et al. | 219/620 |
| 7,947,924 | B2 * | 5/2011 | Niiyama et al. | 219/209 |
| 8,426,782 | B2 * | 4/2013 | Keishima et al. | 219/627 |
| 2005/0242088 | A1 | 11/2005 | Takada et al. | |
| 2006/0049178 | A1 * | 3/2006 | Tominaga | H05B 6/062 219/627 |
| 2009/0001072 | A1 * | 1/2009 | Tominaga et al. | 219/625 |
| 2010/0051608 | A1 * | 3/2010 | Tominaga et al. | 219/621 |
| 2010/0206871 | A1 * | 8/2010 | Kataoka et al. | 219/622 |
| 2011/0073588 | A1 * | 3/2011 | Kusaka et al. | 219/621 |

FOREIGN PATENT DOCUMENTS

| | | | |
|---|---|---|---|
| EP | 1 006 756 | A1 | 6/2000 |
| EP | 1 988 751 | A1 | 11/2008 |
| JP | 02-227986 | A | 9/1990 |
| JP | 3088207 | U | 9/2002 |
| JP | 2004-227976 | A | 8/2004 |
| JP | 2005-024330 | A | 1/2005 |
| JP | 2005-026162 | A | 1/2005 |
| JP | 2005-195435 | A | 7/2005 |
| JP | 2005-203211 | A | 7/2005 |
| JP | 2005-209440 | A | 8/2005 |
| JP | 2006-337345 | A | 12/2006 |

OTHER PUBLICATIONS

International Preliminary Report on Patentability for International Application No. PCT/JP2009/006270, dated Oct. 27, 2011, 3 pages.

Extended European Search Report for European Application No. 09841063.2, dated Feb. 13, 2014, 6 pages.

* cited by examiner

INDUCTION HEATING DEVICE

This application is a 371 application of PCT/JP2009/006270 having an international filing date of Nov. 20, 2009, which claims priority to JP2009-050059 filed on Mar. 4, 2009, the entire contents of which are incorporated herein by reference.

TECHNICAL FIELD

The present invention relates to an induction heating device for inductively heating a cooking container, and more particularly, relates to an induction heating device for performing heating control based on an output of an infrared ray sensor.

BACKGROUND ART

An amount of an infrared ray energy outputted from an infrared ray sensor varies depending on a temperature of the infrared ray sensor. Therefore, a conventional induction heating device (such as a fixing device) have been provided with a cooling means which supplies an air to a temperature detection module (including an infrared ray sensor) to cool the infrared ray sensor in order to suppress a variation of an output of the infrared ray sensor due to a rise of the temperature of the infrared ray sensor itself (refer to Patent Document 1, for example).

Patent Document 1: JP2005-24330A

SUMMARY OF INVENTION

Problems to be Solved by the Invention

However, such conventional structure necessitates the cooling means for cooling the infrared ray sensor and, therefore, induces various problems as follows. For example, in cases of employing a cooling fan as the cooling means, the device has a larger size and, also, operation sounds of the cooling fan provide uncomfortable feelings to users. Further, in cases of employing a Peltier device as the cooling means and structuring the infrared ray sensor such that the temperature thereof is constant, there is the problem of an increased cost of the device. On the other hand, in cases of providing no cooling means, the amount of infrared ray energy outputted from the infrared ray sensor varies according to the temperature of the infrared ray sensor itself. Therefore it is impossible to detect a temperature of an object to be measured (more specifically, a cooking container) with high accuracy.

The present invention has been made in order to solve the above conventional problems and an object thereof is to provide an induction heating device capable of detecting a temperature of an object to be measured (more specifically, a cooking container) with high accuracy without cooling an infrared ray sensor.

Means for Solving the Problems

In order to solve the above problems, an induction heating device of the present invention includes a top plate on which a cooking container is placed, an infrared ray sensor configured to detect an infrared ray radiated from the cooking container through the top plate, a heating coil to which a high-frequency electric current is supplied to generate an induction magnetic field for heating the cooking container, a mounting plate on which a member for supporting the heating coil is mounted, the mounting plate being thermally connected to the infrared ray sensor, a heating control unit configured to control an electric power for heating the cooking container by controlling the high-frequency electric current supplied to the heating coil based on an amount of an energy of the infrared ray received by the infrared ray sensor, and a cooling fan configured to lower a temperature of the mounting plate. Since the infrared ray sensor is thermally connected to the mounting plate having a larger thermal capacity (a larger heat mass), the infrared ray sensor has a large heat mass. This enables stabilizing the temperature of the infrared ray sensor. Since the induction heating device includes the cooling fan configured to lower a temperature of the mounting plate, the temperature of the infrared ray sensor can be stabilized at a lower temperature.

In a case where the above induction heating device further includes a metal case which covers the infrared ray sensor, the infrared ray sensor may be thermally connected to the metal case and the metal case may be thermally connected to the mounting plate, so that the infrared ray sensor is thermally connected to the mounting plate. This can stabilize the temperature of the infrared ray sensor and, also, can prevent the infrared ray sensor from being influenced by noises caused by induction heating.

A material of the mounting plate may be aluminum. Further, a material of at least one of the mounting plate and the metal case may be aluminum. This makes the mounting plate and the metal case themselves less prone to be inductively heated, thereby preventing instability of the temperature of the infrared ray sensor.

The infrared ray sensor may be placed under the mounting plate. This can make the infrared ray sensor less prone to be influenced by noises caused by induction heating, thereby improving the accuracy of temperature measurement by the infrared ray sensor.

In a case where the above induction heating device further includes a temperature measuring unit configured to measure the temperature of the mounting plate, the heating control unit may control the cooling fan to keep the temperature measured by the temperature measuring unit constant. This can improve the stability of the temperature of the infrared ray sensor.

The infrared ray sensor may be of a quantum type. This can improve the accuracy of the temperature measurement by the quantum-type infrared ray sensor.

Effects of the Invention

According to the present invention, the infrared ray sensor is thermally connected to the mounting plate on which the member for supporting the heating coil is mounted and, therefore, the infrared ray sensor has a larger thermal capacity. This can prevent abrupt temperature rise in an infrared ray sensor 3, thereby stabilizing the output of the infrared ray sensor 3. This enables accurately measuring the temperature of the cooking container without cooling the infrared ray sensor.

DETAILED DESCRIPTION OF THE PREFERRED EMBODIMENTS

Hereinafter, embodiments of the present invention will be described with reference to the drawings.

(First Embodiment)

An induction heating device according to the first embodiment of the present invention is configured such that an infrared ray sensor which detects an infrared ray radiated from a cooking container is thermally connected to a mounting plate on which a member for supporting a heating coil is mounted, in order to cause the infrared ray sensor to have a larger thermal capacity, thereby stabilizing the temperature of the infrared ray sensor. This enables accurately detecting a temperature of an object to be measured (more specifically, the cooking container).

1. Configuration of Induction Heating Device

Figure 1:
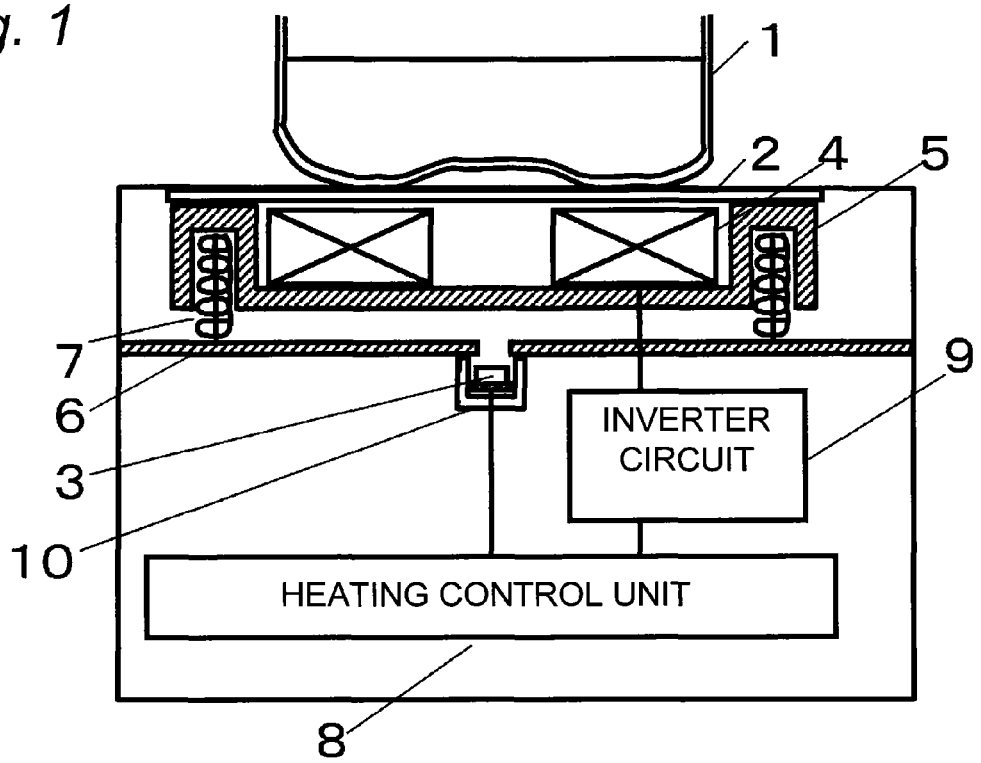
FIG. 1 is a block diagram illustrating an induction heating device according to a first embodiment of the present invention.

FIG. 1 illustrates a block diagram of the induction heating device according to the first embodiment of the present invention. The induction heating device according to the present embodiment includes a top plate 2 on which a cooking container 1 is placed, a heating coil 4 to which a high-frequency electric current is supplied to generate an induction magnetic field for heating the cooking container 1, an infrared ray sensor 3 configured to detect an infrared ray radiated from the cooking container 1 through the top plate 2, a metal case 10 which covers the infrared ray sensor 3, a coil base 5 as a member which supports the heating coil 4, and a mounting plate 6 on which the coil base 5 is mounted.

The induction heating device according to the present embodiment further includes a heating control unit 8 configured to control an electric power for heating the cooking container 1 by controlling an amount of the high-frequency electric current supplied to the heating coil 4, based on an amount of an energy of the infrared ray received by the infrared ray sensor 3, an inverter circuit 9 configured to supply the high-frequency electric current to the heating coil 4 by operating according to commands from the heating control unit 8.

The cooking container 1 is a container (such as a pan, a frying pan or a kettle) which is capable of being inductively heated and into which objects to be heated such as ingredients are put. The cooking container 1 is placed on the top plate 2 which forms a part of the outer contour of the induction heating device. At this time, the cooking container 1 is placed at a position where it faces to the heating coil 4. In the present embodiment, a crystallized glass is employed as the top plate 2, but the top plate 2 is not limited thereto.

The infrared ray sensor 3 receives, through the top plate 2, heat or light in an infrared range which is radiated from the cooking container 1 as an object to be measured. An output of the infrared ray sensor 3 varies according to an amount of light received by the infrared ray sensor 3. The output of the infrared ray sensor 3 is converted into an electric signal, and necessary temperature information is extracted from the electric signal. Infrared ray sensors are broadly classified into an infrared ray sensor of thermal-type and an infrared ray sensor of quantum-type. In the present embodiment, a quantum-type infrared ray sensor (more specifically, a photodiode) is employed, as the infrared ray sensor 3. A quantum-type infrared ray sensor converts a light energy into an electric energy and detects it by utilizing an electric phenomenon induced by light. Specifically, a photodiode utilizes a photovoltaic effect to utilize the fact that, when it receives light, an electric current proportional to the amount of the light flows into the photodiode.

The heating coil 4 generates a high-frequency magnetic field by being supplied with a high-frequency electric current from the inverter circuit 9. The cooking container 1 is heated by an eddy current induced in the cooking container 1 by the high-frequency magnetic field.

The coil base 5 supports the heating coil 4. The coil base 5 is supported by support springs 7 at positions defined by the mounting plate 6, such that there is a constant distance between the top plate 2 and the heating coil 4. If the distance between the heating coil 4 and the cooking container 1 is increased, this will decrease an amount of a magnetic flux in which the high-frequency magnetic field generated from the heating coil 4 interlinks with the cooking container 1, thereby decreasing the heating output. Therefore, the distance between the heating coil 4 and the cooking container 1 is an important factor. In the present embodiment, as illustrated in FIG. 1, the coil base 5 on which the heating coil 4 is placed is pressed against the top plate 2 through the support springs 7.

The position of the heating coil 4 is determined by the positions of the support springs 7. The support springs 7 are secured to the mounting plate 6 to define the position of the heating coil 4 in the horizontal direction.

The mounting plate 6 supports the coil base 5 with the support springs 7. The mounting plate 6 has a large area for covering the heating control unit 8 and the inverter circuit 9 in their entirety and physically separates the heating coil 4 from the heating control unit 8 and the inverter circuit 9 and the like. Thus, the mounting plate 6 prevents malfunctions of the heating control unit 8 and the inverter circuit 9 due to the high-frequency magnetic field generated by the heating coil 4.

In the induction heating device, the heating coil 4 generates a high-frequency magnetic field. If the infrared ray sensor 3 is influenced by the high-frequency magnetic field, this will cause instability of the output value of the infrared ray sensor 3. Specifically, in the case of employing a photodiode as the infrared ray sensor 3, the infrared ray sensor 3 is prone to be influenced by the high-frequency magnetic field since the photodiode generally outputs the electric current on the order of microamperes or less. In order to make the infrared ray sensor 3 less prone to be influenced by the high-frequency magnetic field, in the present embodiment, the infrared ray sensor 3 is housed in the metal case 10 for preventing magnetization.

Further, in the present embodiment, the infrared ray sensor 3 is thermally connected to the metal case 10, and the metal case 10 is thermally connected to the mounting plate 6, so that the infrared ray sensor 3 is thermally connected to the mounting plate 6. Thus, the infrared ray sensor 3 has an increased thermal capacity, thereby preventing abrupt temperature rises in the infrared ray sensor 3.

In the present embodiment, the infrared ray sensor 3 is placed under the mounting plate 6 which supports the heating coil 4. This further prevents the infrared ray sensor 3 from being influenced by the high-frequency magnetic field generated from the heating coil 4.

The material of at least one of the mounting plate 6 and the metal case 10 (both of them in the present embodiment) is aluminum. Aluminum is a material which is less prone to be inductively heated and, also, is a material with a preferable thermal conductivity. Therefore, the use of aluminum makes the mounting plate 6 and the metal case 10 themselves less prone to be inductively heated.

The heating control unit 8 is connected to the infrared ray sensor 3, the inverter circuit 9, an operation unit (not illustrated), and the like. The heating control unit 8 converts a physical amount (for example, an output voltage) outputted from the infrared ray sensor 3 according to an amount of infrared energy received by the infrared ray sensor 3 into the temperature of the cooking container 1. The heating control unit 8 controls the inverter circuit 9 to perform the heating control for the cooking container 1 based on the temperature of the cooking container 1 which has been resulted from the conversion. For example, when the temperature of the cooking container 1 has been excessively raised, the heating control unit 8 controls the inverter circuit 9 to stop the heating. Further, for example, in operations in an automatic cooking mode, the heating control unit 8 controls the inverter circuit 9 in such a way as to attain the temperature corresponding to the content of the automatic cooking. Further, if a user of the induction heating device starts or stops heating or adjusts the heating output through the operation unit, the heating control unit 8 controls the inverter circuit 9 to execute desired operations instructed by the user.

2. Operation of Induction Heating Device

Hereinafter, the induction heating device having the above structure will be described with respect to operations thereof.

At first, there will be described the heating control for heating the cooking container 1 according to the heating power set by the user. If the user pushes a switch for instructing to start heating on the operation unit (not illustrated), a control command to start heating is inputted to the induction heating device according to the present embodiment. The heating control unit 8 operates the inverter circuit 9 to supply a high-frequency electric current to the heating coil 4. This causes the heating coil 4 to generate a high-frequency magnetic field, and the heating of the cooking container 1 is started.

The heating control unit 8 controls the inverter circuit 9 such that the heating power applied to the cooking container 1 is coincident with the heating power set by the user operating the operation unit. More specifically, for example, the heating control unit 8 detects an input electric current of the inverter circuit 9 to input the detected value. The heating control unit 8 compares the heating power set by the user with the input electric current of the inverter circuit 9 to change the operation state of the inverter circuit 9. The heating control unit 8 repeats these operations to match the heating power applied to the cooking container 1 with the heating power set by the user and maintain the matched heating power.

When the cooking container 1 is heated to make the temperature of the cooking container 1 higher, the heating control unit 8 determines, based on the temperature detected by the infrared ray sensor 3, whether or not the detected temperature of the cooking container 1 is equal to or higher than the set value (for example, 300° C.), for example. If the detected temperature is equal to or higher than the set value, the heating control unit 8 determines that anomalous heating occurs. If the detected temperature is lower than the set value, the heating control unit 8 determines that the heating is normally executed. In the event of anomalous heating, the heating control unit 8 performs the control for temporarily stopping the inverter circuit 9, or the like. On the other hand, when the heating is normally executed, the heating is continued.

Next, there will be described cooking for fried food, as one of automatic cooking functions. For example, if the user sets the set temperature at 180° C. through a temperature adjustment switch after pushing a fried-food automatic cooking start switch (not illustrated) on the operation unit, the heating control unit 8 controls the inverter circuit 9, based on the temperature detected by the infrared ray sensor 3, such that the temperature of an oil put in the cooking container 1 reaches the set temperature of 180° C. For example, if an ingredient is introduced into the cooking container 1 to cause the temperature of the oil to be equal to or lower than 180° C., the heating control unit 8 performs control for changing the operation state of the inverter circuit 9 such that the temperature of the oil reaches 180° C.

As described above, when the cooking container 1 is heated by performing the heating control according to the heating power set by the user or the control according to the automatic cooking function for fried food, the temperature of the infrared ray sensor 3 itself is raised, due to the heat generation from the heating coil 4 and, furthermore, due to the radiation heat from the top plate 2 caused by transfer of heat from the cooking container 1 to the top plate 2.

Figure 2:
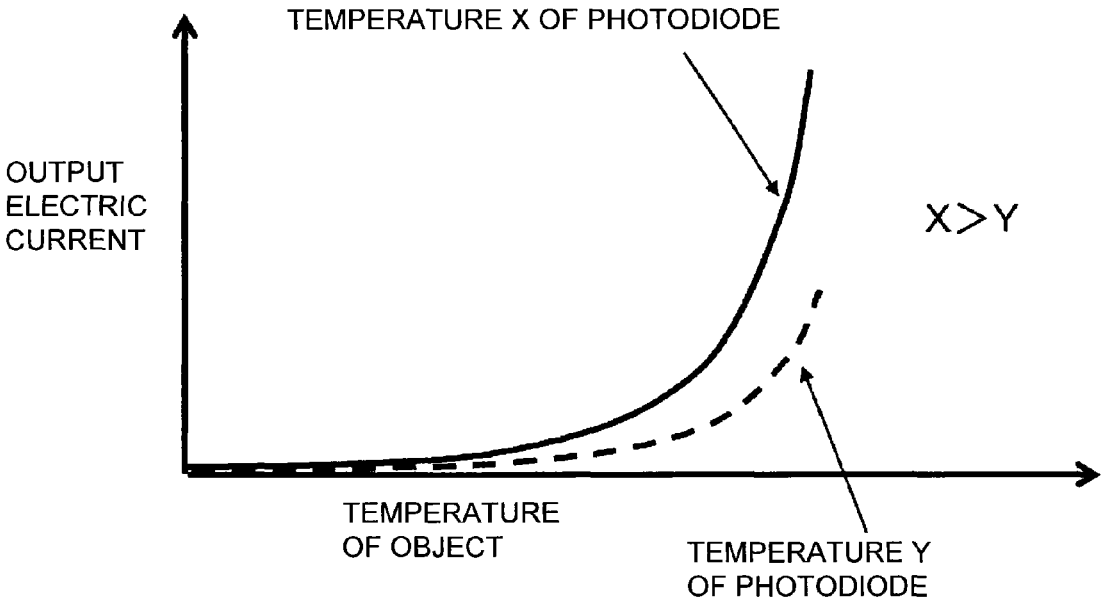
FIG. 2 is a view illustrating a characteristic of an output electric current with respect to a temperature of a photodiode in the induction heating device according to the first embodiment of the present invention.

FIG. 2 illustrates a characteristic of the output electric current of an ordinary photodiode with respect to the temperature. As illustrated in FIG. 2, the photodiode has the characteristic of varying the value of the electric current outputted from the photodiode depending on the temperature of the photodiode itself. When the temperature of the photodiode is X° C. which is a higher temperature, in comparison with when the temperature of the photodiode is Y° C. which is a lower temperature, the photodiode outputs a larger electric current, even for the same temperature of the object to be measured. If the temperature of the photodiode is varied as described above, this will change the relationship between the electric current outputted from the photodiode and the temperature of the object, thereby resulting in an increase of the magnitudes of errors in the measurement of the temperature of the object.

Therefore, it is desirable to prevent the rise of the temperature of the infrared ray sensor 3 and maintain the temperature of the infrared ray sensor 3 at constant temperature. To cope therewith, in the present embodiment, the infrared ray sensor 3 is thermally connected to the mounting plate 6 in order to cause the infrared ray sensor 3 to have a lager thermal capacity (heat mass). By causing the infrared ray sensor 3 to have such a heat mass for preventing abrupt changes in the temperature of the infrared ray sensor 3, it is possible to stabilize the temperature of the infrared ray sensor 3. This makes it easier to correct the detected temperature of the cooking container 3 based on the output of the infrared ray sensor 3.

In the present embodiment, "the temperature of the infrared ray sensor" refers to the temperature at the part which receives heat or light of infrared ray. This part is usually connected to a terminal of the infrared ray sensor 3 and exhibits a temperature value closer to the actual temperature of the infrared ray sensor 3. The mounting plate 6 has a large area for covering the heating control unit 8 and the inverter circuit 9 in their entirety. Further, the mounting plate 6 has a certain thickness, since it is required to have strength for supporting the heating coil 4. Accordingly, the mounting plate 6 has a large volume and has a sufficiently-large heat mass. This mounting plate 6 and the infrared ray sensor 3 are thermally connected to each other through the metal case 10, so that the infrared ray sensor 3 has a larger heat mass, thereby facilitating stabilization of the temperature.

3. Conclusion

In the present embodiment, the infrared ray sensor 3 is thermally connected to the metal case 10 and, further, the metal case 10 is thermally connected to the mounting plate 6, so that the infrared ray sensor 3 is thermally connected to the mounting plate 6. Accordingly, the infrared ray sensor 3 has a larger thermal capacity due to the large thermal capacity of the mounting plate 6. This can suppress abrupt temperature rises in the infrared ray sensor 3 itself, thereby stabilizing the temperature detected by the infrared ray sensor 3. This enables accurately measuring the temperature of the cooking container 1 based on the output of the infrared ray sensor 3.

This can improve the temperature controllability in heating control and automatic cooking, thereby improving the quality of cooked food.

Further, since the infrared ray sensor 3 is covered with the metal case 10, it is possible to alleviate the influence of the high-frequency magnetic field from the heating coil 4 to the infrared ray sensor 3. This can further stabilize the value of the output of the infrared ray sensor 3. This enables measuring the temperature of the cooking container 1 more accurately.

Further, the mounting plate 6 and the metal case 10 are made of aluminum which is a material being less prone to be inductively heated and also having a preferable heat conductivity. This makes the mounting plate 6 and the metal case 10 less prone to be inductively heated, thereby further suppressing temperature rises in the infrared ray sensor 3. The temperature of the infrared ray sensor 3 is uniformized, which can prevent instability of the temperature of the infrared ray sensor.

In order to alleviate the influence of the temperature rise in the infrared ray sensor 3, there is a method in which the photodiode is cooled for preventing temperature rises in the photodiode itself, but, in this case, it is necessary to maintain the temperature of the photodiode constant. However, if the temperature of the photodiode is fluctuated, this will cause variations in the value of the electric current outputted from the photodiode even when the temperature of the object is constant, thereby making it impossible to reduce errors in measurement of the temperature of the object. Specifically, in a case where cool air is directly given to the photodiode, it is hard to keep the temperature of the photodiode constant. Further, if a cooling means is provided, this will induce the problem of an increase of the size of the device and the problem of operation sounds of the cooling fan which provide uncomfortable feelings to the user. However, in the present embodiment, the influence of the temperature rise in the infrared ray sensor is alleviated without cooling the photodiode, which prevents occurrences of these problems.

In order to alleviate the influence of the temperature rise in the infrared ray sensor 3, there is a method in which the temperature of the photodiode itself is measured and, then, based on the measured temperature, the conversion temperature of the cooking container is corrected. However, this case involves a complicated structure for measuring the temperature of the photodiode and, also, involves an increase of the cost of the device itself. Further, in this case, there is a need for means for calculating or storing correction values corresponding to the temperature of the photodiode. However, in the present embodiment, the influence of the temperature rise in the infrared ray sensor is alleviated without measuring the temperature of the photodiode itself, which prevents occurrences of these problems.

Further, the mounting plate 6 physically separates the heating coil 4 from the heating control unit 8 and the inverter circuit 9, which can prevent malfunctions of the heating control unit 8 and the inverter circuit 9 due to the high-frequency magnetic field generated from the heating coil 4.

Further, the infrared ray sensor 3 is mounted under the mounting plate 6, which can provide an effect of preventing magnetization through the mounting plate 6.

Since the infrared ray sensor 3 is formed from a quantum-type infrared ray sensor capable of stabilizing the output thereof by stabilizing the temperature of the sensor, it is possible to improve the accuracy of the temperature measurement by the infrared ray sensor 3.

4. Modified Examples

Further, although the infrared ray sensor 3 can be mounted closer to the heating coil 4 above the mounting plate 6, it is possible to further enhance the magnetization preventing effect by mounting it under the mounting plate 6. This enables provision of a sufficient magnetization preventing effect even when the metal case 10 has a reduced plate thickness, thereby enabling simplification of the metal case 10. For example, even with a structure which is not provided with the metal case 10, it is possible to provide a magnetization preventing effect. The infrared ray sensor 3 can be made less prone to be influenced by noises caused by induction heating, thereby improving the accuracy of the temperature measurement by the infrared ray sensor 3.

Further, while, in the present embodiment, a quantum-type infrared ray sensor is employed as the infrared ray sensor 3, it is also possible to employ a thermal-type infrared ray sensor. Such a thermal-type infrared ray sensor is configured such that the sensor is heated through a heating effect of infrared ray and detects changes of electric characteristics of the device due to the rise of the temperature of the device. For example, it is possible to employ a thermopile of the thermal-type infrared ray sensor. The thermal-type infrared ray sensor varies its output, with the temperature of the sensor itself, similarly to the quantum-type infrared ray sensor. The thermopile is capable of generating an output signal corresponding to the infrared ray energy and measuring the temperature of an object to be measured based on the output signal and the temperature of the thermopile itself.

(Second Embodiment)

An induction heating device according to a second embodiment of the present invention further includes a cooling unit configured to cool the mounting plate 6. The other structures are the same as those in the first embodiment. The same structures as those in the first embodiment will not be described, and only different points will be described hereinafter.

Figure 3:
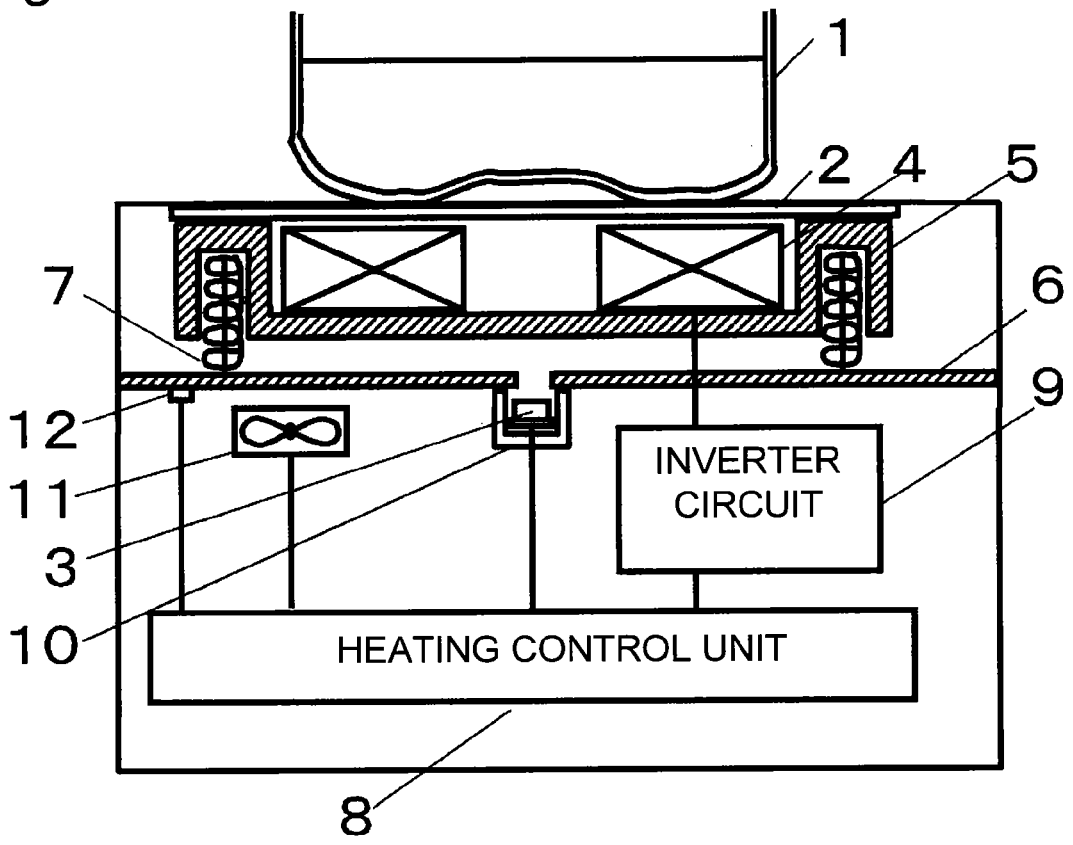
FIG. 3 is a block diagram illustrating an induction heating device according to a second embodiment of the present invention.

FIG. 3 illustrates a block diagram of the induction heating device according to the second embodiment of the present invention. The induction heating device according to the present embodiment further includes the cooling unit 11, as illustrated in FIG. 3. The cooling unit 11 cools the mounting plate 6. The cooling unit 11 according to the present embodiment is a cooling fan. The cooling unit 11 is connected to the heating control unit 8. The heating control unit 8 starts a cooling operation with the cooling unit 11 when the cooking container 1 is heated.

Since the infrared ray sensor 3 is thermally connected to the mounting plate 6, the temperature of the infrared ray sensor 3 does not change rapidly. However, when the cooking container 1 is continuously heated, the temperatures of the heating coil 4 and the top plate 2 are raised, and the heating coil 4 and the top plate 2 generate heat of radiation. This heat of radiation gradually raises the temperature of the mounting plate 6 having a large heat mass, which results in a rise of the temperature of the infrared ray sensor 3.

However, in the present embodiment, the cooling unit 11 cools the mounting plate 6 having the large heat mass, rather than directly cooling the infrared ray sensor 3. This can prevent the rise of the temperature of the mounting plate 6. This can keep the temperature of the infrared ray sensor 3 constant, thereby stabilizing the output of the infrared ray sensor 3.

As described above, in the present embodiment, the induction heating device is provided with the cooling unit 11 configured to lower the temperature of the mounting plate 6. Thus, the temperature of the infrared ray sensor 3 can be prevented from changing. This can keep the temperature of the infrared ray sensor 3 constant, thereby stabilizing the output of the infrared ray sensor 3.

Further, while, in the present embodiment, a cooling fan is employed as the cooling unit 11, the cooling unit 11 may be a Peltier device.

Further, the induction heating device according to the present embodiment may further include a temperature measuring unit 12 configured to measure the temperature of the mounting plate 6. In this case, the heating control unit 8 or the temperature measuring unit 12 can be configured to control the cooling unit 11 to keep the temperature measured by the temperature measuring unit 12 constant in order to improve the stability of the temperature of the infrared ray sensor 3. Further, the cooling unit 11 is not necessarily required to be connected to the heating control unit 8.

Although the present invention has been described in connection with specified embodiments thereof, many other modifications, corrections and applications are apparent to those skilled in the art. Therefore, the present invention is not limited by the disclosure provided herein but limited only to the scope of the appended claims.

INDUSTRIAL APPLICABILITY

The induction heating device according to the present invention has an effect of stabilizing the temperature of the infrared ray sensor and accurately measuring the temperature of the cooking container and, therefore, is usable as induction heating devices used in standard homes, restaurants and offices.

The invention claimed is:

1. An induction heating device comprising:

a top plate on which a cooking container is placed;

an infrared ray sensor configured to detect an infrared ray radiated from the cooking container through the top plate;

a heating coil disposed below the top plate to which a high-frequency electric current is supplied to generate an induction magnetic field for heating the cooking container;

a mounting plate disposed below the heating coil on which a member for supporting the heating coil is mounted, a material of the mounting plate being aluminum;

a heating control unit configured to control an electric power for heating the cooking container by controlling the high-frequency electric current supplied to the heating coil based on an amount of an energy of the infrared ray received by the infrared ray sensor;

a cooling fan configured to lower a temperature of the mounting plate; and a metal case which covers the infrared ray sensor, wherein the infrared ray sensor is in physical contact with the metal case and the metal case is in physical contact with the mounting plate, so that the infrared ray sensor is thermally coupled to the mounting plate.

2. The induction heating device according to claim 1, wherein a material of the metal case is aluminum.

3. The induction heating device according to claim 1, wherein the infrared ray sensor is placed under the mounting plate.

4. The induction heating device according to claim 1, further comprising a temperature measuring unit configured to measure a temperature of the mounting plate, wherein the heating control unit controls the cooling fan to keep the temperature measured by the temperature measuring unit constant.

5. The induction heating device according to claim 1, wherein the infrared ray sensor is of a quantum type.

* * * * *